US010223882B2

(12) United States Patent
Grant et al.

(10) Patent No.: US 10,223,882 B2
(45) Date of Patent: Mar. 5, 2019

(54) ALARMING CABLES, ASSEMBLIES, AND SYSTEMS

(71) Applicant: InVue Security Products Inc., Charlotte, NC (US)

(72) Inventors: Jeffrey A. Grant, Charlotte, NC (US); Gary A. Taylor, Fort Mill, SC (US); Robert Schultz, Charlotte, NC (US); Christopher J. Fawcett, Charlotte, NC (US); Larry T. McKinney, Huntersville, NC (US); Kirk Burmeister, II, Charlotte, NC (US); James K. Sankey, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 807 days.

(21) Appl. No.: 14/278,563

(22) Filed: May 15, 2014

(65) Prior Publication Data

US 2014/0340225 A1 Nov. 20, 2014

Related U.S. Application Data

(60) Provisional application No. 61/824,386, filed on May 17, 2013, provisional application No. 61/833,067, (Continued)

(51) Int. Cl.
*G08B 13/14* (2006.01)

(52) U.S. Cl.
CPC ..... *G08B 13/1445* (2013.01)

(58) Field of Classification Search
CPC ..... G08B 13/1445
See application file for complete search history.

(56) References Cited

U.S. PATENT DOCUMENTS 5,034,723 A 7/1991 Maman
5,142,269 A 8/1992 Mueller
(Continued)

FOREIGN PATENT DOCUMENTS

CN 201937127 U 8/2011
JP 2010140388 A 6/2010
KR 10-2012-0116599 10/2012

OTHER PUBLICATIONS

Blaine R. Copenheaver, "The International Search Report and the Written Opinion of the International Searching Authority or the Declaration for International Application No. PCT/US2014/038182 filed on May 15, 2014, Oct. 10, 2014, 10 pages, Commissioner for Patents, Alexandria, Virginia".
(Continued)

*Primary Examiner* — Joseph H Feild
*Assistant Examiner* — Pameshanand Mahase
(74) *Attorney, Agent, or Firm* — InVue Security Products Inc.

(57) ABSTRACT

Alarming cables, assemblies and systems for displaying and protecting a powered article of merchandise from theft include an alarm unit disposed between a first cable having a first connector for connection to a power source and a second cable having a second connector for connection to the merchandise. An alarm unit connector may connect the second cable to the alarm unit. The alarm unit and the alarm unit connector may each include a connection member to electrically connect the merchandise with the alarm unit and the power source when the alarm unit connector aligns with and engages the alarm unit.

28 Claims, 15 Drawing Sheets

Related U.S. Application Data filed on Jun. 10, 2013, provisional application No. 61/840,749, filed on Jun. 28, 2013.

(56) References Cited

U.S. PATENT DOCUMENTS

| | | | |
|---|---|---|---|
| 5,418,521 | A | 5/1995 | Read |
| 5,552,771 | A | 9/1996 | Leyden et al. |
| 6,147,603 | A | 11/2000 | Rand |
| 6,150,940 | A | 11/2000 | Chapman et al. |
| 6,300,874 | B1 | 10/2001 | Rand |
| 6,337,633 | B1 | 1/2002 | Foseide |
| RE37,590 | E | 3/2002 | Leyden et al. |
| 6,459,374 | B1 | 10/2002 | Rand et al. |
| 6,462,668 | B1 | 10/2002 | Foseide |
| 7,209,038 | B1 | 4/2007 | Deconinck et al. |
| 7,936,267 | B2 | 5/2011 | Pasma |
| 8,517,748 | B1 | 8/2013 | Kelsch et al. |
| D702,576 | S | 4/2014 | McKinney et al. |
| D705,104 | S | 5/2014 | McKinney et al. |
| 9,000,920 | B2 | 4/2015 | Fawcett et al. |
| 2002/0113704 | A1 | 8/2002 | Hess |
| 2003/0210144 | A1 | 11/2003 | Ott |
| 2007/0159328 | A1 | 7/2007 | Belden et al. |
| 2008/0169923 | A1 | 7/2008 | Belden et al. |
| 2008/0300572 | A1* | 12/2008 | Rankers ..... A61B 5/14532 604/504 |
| 2010/0141424 | A1* | 6/2010 | Coloma Calahorra ..... G08B 13/1409 340/539.1 |
| 2010/0301998 | A1* | 12/2010 | Marszalek ..... G08B 13/1445 340/5.65 |
| 2012/0019383 | A1 | 1/2012 | Fawcett et al. |
| 2012/0120571 | A1 | 5/2012 | Bisesti et al. |
| 2013/0063267 | A1* | 3/2013 | Yunker ..... H03K 17/962 340/571 |
| 2013/0194096 | A1 | 8/2013 | Belden, Jr. et al. |
| 2013/0307692 | A1* | 11/2013 | Fawcett ..... G08B 13/1445 340/568.2 |
| 2014/0028462 | A1* | 1/2014 | Lawson ..... G08C 17/02 340/870.01 |

OTHER PUBLICATIONS

European Application No. 14798430.6, Supplementary European Search Report, dated May 3, 2016, 13 pages.

"J-PLUG", 2012, 11 pages, MulTplx Security Products, London, England.

Design U.S. Appl. No. 29/481,468, filed Feb. 6, 2014.

* cited by examiner

ALARMING CABLES, ASSEMBLIES, AND SYSTEMS

CROSS REFERENCE TO RELATED APPLICATIONS

This application claims the benefit of priority to U.S. Provisional Application No. 61/824,386 filed on May 17, 2013, and to U.S. Provisional Application No. 61/833,067 filed on Jun. 10, 2013, and to U.S. Provisional Application No. 61/840,749 filed on Jun. 28, 2013, the entire disclosures of which are incorporated herein by reference.

FIELD OF THE INVENTION

Embodiments of the present invention relate generally to alarming cables, assemblies, and systems for displaying and protecting an article of merchandise from theft.

BACKGROUND OF THE INVENTION

Retailers routinely display handheld electronic merchandise, such as mobile (e.g. cellular) telephones, iPods, game consoles, personal data assistants (PDAs), and the like, for customers to examine before making a purchase. Retailers often desire the handheld electronic merchandise to be powered as well so that a potential purchaser can test the operation and functions of the merchandise. At the same time, the retailer does not want the article of merchandise to be stolen or removed from the display area by an unauthorized person. Accordingly, the article of merchandise being displayed is attached to a merchandise display security device that protects the article of merchandise from theft and unauthorized removal. Such a merchandise display security device typically includes a sensor housing to which the article of merchandise is attached that houses a sensor for monitoring whether the article of merchandise remains attached to the sensor housing. In the event that the article of merchandise is detached from the sensor housing, an audible and/or visible alarm is activated to alert store personnel to the situation.

Oftentimes it is desirable for a retailer to provide power to the merchandise for facilitating operation of the device on display, as well as for charging the internal power supply of the device. For example, a power adaptor cord may be used to power the handheld electronic merchandise, or alternatively, to charge an internal battery that powers the article of merchandise in the absence of an external power source (including a power source of the merchandise display security device). Furthermore, the article of merchandise may be physically secured to the display with a tether. The tether may not only provide physical security, but may also serve to provide power to the sensor and/or to the article of merchandise. However, the existing merchandise displays oftentimes require specialized tethers and power adapter cords that are hardwired to the sensor.

Accordingly, there exists a need for alarming cables, assemblies, and systems for displaying and protecting a powered article of merchandise from theft.

SUMMARY OF THE INVENTION

In one aspect, the present invention is embodied by an alarming cable system for protecting an article of merchandise from theft including a first cable, a first connector at an end of the first cable for connecting to a power source, a second cable, a second connector at an end of the second cable for connecting to the article of merchandise, and an alarm unit operably coupled with the first cable. The alarm unit has an upper surface, a lower surface, and a lateral surface extending therebetween. The lower surface is configured to be secured to a support surface, and the alarm unit is configured to operably couple with the second cable. The alarm unit is configured to generate a security signal in the event that the second connector of the second cable is disconnected from the article of merchandise and/or in the event that the first cable is cut or the second cable is cut.

In one embodiment, the alarming cable system the second cable includes a ring-shaped third connector opposite the second connector that is configured to releasably connect to the alarm unit. In another embodiment, the alarm unit further includes a port disposed within a ring-shaped protrusion that is configured to receive a wireless security signal for arming and/or disarming the alarm unit. In yet another embodiment, the third connector includes a plurality of conductive elements that are configured to align with and engage corresponding conductive elements of the alarm unit. In still another embodiment, the lower surface of the alarm unit defines an angle relative to the upper surface of the alarm unit, and the third connector includes at least one magnetically attractive element for positioning the article of merchandise in a predetermined orientation.

In another aspect, the present invention is embodied by an alarm unit assembly for protecting an article of merchandise from theft including a first cable, a connector at an end of the first cable for connecting to a power source, and an alarm unit operably coupled with the first cable. The alarm unit is configured to generate a security signal in the event that the first connector is disconnected and/or in the event that the first cable is cut. The alarm unit includes a base configured to be secured to a support surface and a protrusion extending from the base. The alarm unit further includes at least one connection member operably engaged with the protrusion and recessed relative to the base. The connection member is configured to operably engage a second cable such that the alarm unit and the second cable are in electrical communication. In one embodiment, the base defines a slot, and the connection member is disposed within the slot. In yet another embodiment, the alarm unit assembly further includes a port disposed within the protrusion that is configured to receive a wireless security signal. In still another embodiment, the protrusion is ring-shaped.

In another aspect, the present invention is embodied by an alarming cable system for protecting an article of merchandise from theft including a first cable, a first connector at an end of the first cable for connecting to a power source, a second cable, a second connector at an end of the second cable for connecting to the article of merchandise, a third connector at an opposite end of the second cable having at least one first connection member, and an alarm unit operably coupled with the first cable. The alarm unit includes a base configured to be secured to a support surface and a protrusion extending from the base. The alarm unit further includes at least one second connection member operably engaged with the base and operably coupled with the first cable. The first connection member is configured to operably engage the second connection member such that the alarm unit and the second cable are in electrical communication. The alarm unit is configured to generate a security signal in the event that the second connector is disconnected from the article of merchandise, in the event that the first cable is cut or the second cable is cut and/or in the event that the first connection member and the second connection member are disengaged from one another. In one embodiment, the third connector defines a central opening and the first connection member is disposed within the central opening of the third connector. In another embodiment, the third connector is ring-shaped. In yet another embodiment, the first connection member and the second connection member are not visible when engaged with one another.

In another aspect, the invention is embodied by a method for protecting an article of merchandise from theft. The method includes providing an alarming cable including a cable, a first connector at an end of the cable, a second connector at an end of the cable opposite the first connector, and an alarm unit operably engaged with the cable and disposed between the first connector and the second connector. The method further includes connecting the first connector to a power source, connecting the second connector to the article of merchandise, and arming the alarm unit to generate an alarm in the event that the second connector is removed from the article of merchandise and/or in the event that the cable is cut

BRIEF DESCRIPTION OF THE DRAWING FIGURES

DETAILED DESCRIPTION OF EMBODIMENTS OF THE INVENTION

Exemplary embodiments of the present invention are generally directed to alarming cables, assemblies, and systems for displaying and protecting a powered article of merchandise from theft. In particular, exemplary embodiments of alarming cables, assemblies and systems are provided for monitoring an article of merchandise and for activating an audible and/or visible alarm in the event that the article of merchandise is separated from the alarming cable, assembly or system. The article of merchandise may be any of a variety of consumer electronic devices, such as a mobile (e.g. cellular) telephone, iPod, game console, personal data assistant (PDA), tablet, portable computer, speaker, headphones, or the like. The article of merchandise may be attached to the alarming cable, assembly or system in a manner so as to allow customers to examine and operate the merchandise before making a decision to purchase.

In some embodiments, the alarming cable, assembly or system comprises a Universal Serial Bus (USB) cable. In this regard, one end of the cable may include a standard USB connector, such as a USB Standard Type-A or Type-B connector, while the other end may have another USB connector, such as a micro-USB or mini-USB connector for attaching to an article of merchandise. However, the connectors may be the same USB type in some embodiments. Alternatively, the alarming cable, assembly or system may be provided with a variety of different type of connectors at a free end thereof to accommodate the various types of power input jacks (e.g., cellular telephone power input jacks) provided on different articles of merchandise. The alarming cable, assembly or system typically includes an alarm unit that is configured to emit an audible and/or visual alarm in the event that either end of the cable is unplugged, or in the event that the cable is cut.

Figure 1:
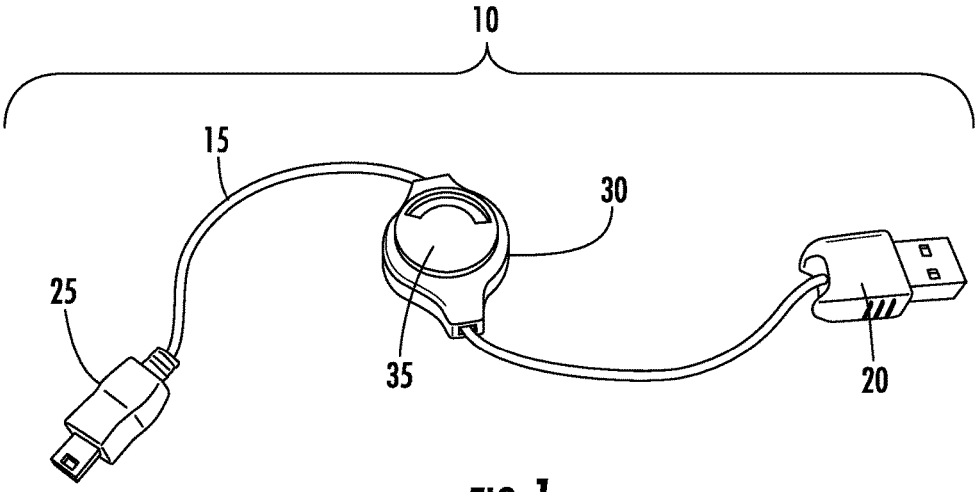
FIG. 1 is a perspective view showing an exemplary embodiment of an alarming cable according to the present invention.

In an exemplary embodiment shown in FIG. 1, an alarming cable 10 according to the present invention comprises a cable 15 having a first connector 20 that is configured to directly or indirectly couple to a power source, such as a computing device (e.g., a PC or portable computer), a power outlet, or a wall power adapter at one end, and a second connector 25 at an opposite end of the cable 15 for operably engaging an article of merchandise (e.g., mobile device). Accordingly the second connector 25 is compatible with an input port on the article of merchandise. As a result, the alarming cable 10 both mechanically and electrically connects the article of merchandise to a power source. The alarming cable 10 is configured to provide power and may in addition provide data download and/or data syncing to the article of merchandise. The alarming cable 10 may comprise an integral alarm unit 30 that will generate an audible and/or visual alarm when either the first connector 20 or the second connector 25 is unplugged, or the cable 15 is cut anywhere along its length (e.g., electrical continuity is interrupted).

In some embodiments, the alarm unit 30 can be armed, disarmed, and/or silenced with a security key, which may utilize mechanical, wireless, and/or wired electrical communication between the alarm unit and the security key. For example, the security key may be configured to wirelessly communicate a security code to the alarm unit 30, such as by infrared, optical, acoustic, or inductive communication. The alarm unit 30 may include a port 42 configured to receive wireless signals from the security key. In one particular embodiment, the security key is similar to that disclosed in U.S. Pat. No. 7,737,845, entitled Programmable Key for a Security System for Protecting Merchandise, the relevant disclosure of which is incorporated herein by reference. In another embodiment, the alarm unit 30 may include near field communication (NFC) functionality and be configured to communicate with a security key or device having NFC functionality for arming and disarming the alarm unit. Alternatively, the alarm unit 30 may include "screen swipe" functionality and/or be configured to sense particular movement or motion of the alarm unit to arm or disarm the alarm unit. Likewise, the alarm unit 30 may include biometric functionality for recognizing biological features of a particular user to arm or disarm the alarm unit.

The alarm unit 30 may include an audible and/or visual alarm for generating a security signal in response to a security event (e.g., either first connector 20 or second connector 25 of the cable 15 is unplugged, or the electrical continuity of the cable is compromised). For example, the alarm unit 30 may include a piezoelectric alarm to generate an audible signal, as well as circuitry for detecting a security event. The alarm unit 30 may be further configured to detect a mechanical and/or electrical connection of either connector 20, 25 to the article of merchandise or the power source, respectively. The alarm unit 30 may further include an internal power source configured to provide back-up power to the alarm unit in the event that power from an external power source is interrupted or lost. In one embodiment, the internal power source is a rechargeable battery that is recharged as necessary by power supplied by the external power source through the cable 15.

Figure 2:
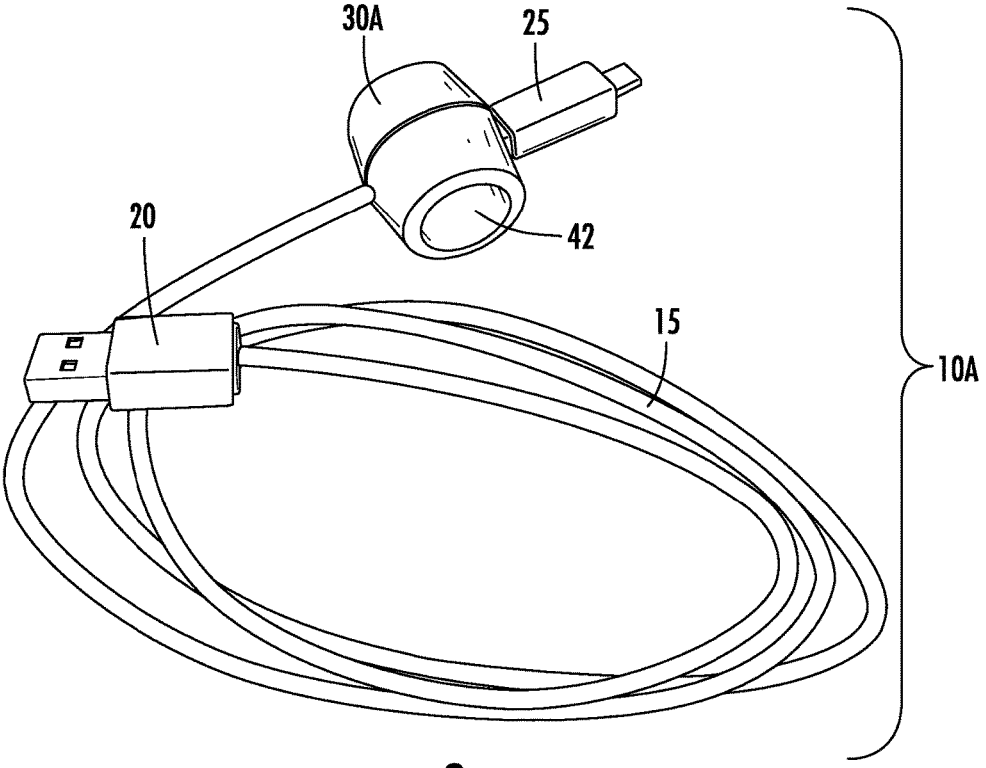
FIG. 2 is a perspective view showing another exemplary embodiment of an alarming cable according to the present invention.

The cable 15 may be any desired length, and the alarm unit 30 may be positioned anywhere along the length of the cable between the first connector 20 and the second connector 25. In the embodiment shown in FIG. 1, the alarm unit 30 is disposed in-line with the cable 15 and spaced apart from either of the connectors 20, 25. In another exemplary embodiment of the alarming cable 10A shown in FIG. 2, the alarm unit 30A is disposed in-line with the cable 15 and adjacent to one of the connectors 20, 25. For example, the alarm unit 30A may be positioned adjacent to the second connector 25 configured for engaging the input port provided on the article of merchandise. If desired, the alarming cable 10 may include a recoiler 35 that is configured to adjust a relative distance between the alarm unit 30 and one or both of the connectors 20, 25. For example, the cable 15 may be configured to recoil into a "floating recoiler" 35, as shown in FIG. 1. Thus, the alarm unit 30 and recoiler 35 may be disposed in-line along the length of the cable 15 between the connectors 20, 25, and the cable 15 may be adjustable in length.

In some embodiments, the alarm unit 30 is configured to communicate various signals through the cable 15. For example, the alarm unit 30 may be configured to communicate with an article of merchandise via USB signals through its USB input port. The USB signals may be used to indicate when the article of merchandise is connected to the alarm unit, disconnected from the alarm unit, charging, etc. With a standard mobile device that has USB functionality, when connecting or disconnecting the USB connector, there is a protocol of information that is transferred between the host and the device. This communication can be used to determine if the device is connected to the host via the cable or not. As such, the alarm unit 30 may communicate with the article of merchandise through USB protocols. According to another embodiment, the article of merchandise may include a software application that will allow the merchandise to communicate with the alarm unit (e.g., host) 30, and thereby provide additional security information, such as location, motion, temperature, camera image, data usage, etc.

As shown in the exemplary embodiments provided herein, the alarming cable 10, 10A may comprise a first connector 20 and a second connector 25 disposed at opposite ends of an electrical cable 15. In other embodiments, the alarming cable 10, 10A may comprise a single connector 25 at one end configured for connection to an article of merchandise. The alarm unit 30, 30A may include a connector or input port that is configured to operably engage an original equipment manufacturer (OEM) cable to thereby provide power to the alarm unit and the article of merchandise. The OEM cable may thus connect directly to the alarm unit 30, 30A at one end and to a power source at another, opposite end. As such, the alarm unit 30, 30A may be disposed in-line between the article of merchandise and the OEM cable. The OEM cable and alarm unit 30, 30A may include any suitable type of connector, such as respective male and female micro-USB connectors.

The alarm unit 30 may be operably engaged with the cable 15 in a variety of manners. For example, the alarm unit 30 may be hardwired to each end of the cable 15 and have conductors configured to cooperate with conductors provided in the cable. Alternatively, the cable 15 may plug into the alarm unit 30 at a pair of locations thereon, such that the cable comprises two segments, with each segment having a pair of connectors at opposite ends. In another embodiment, the cable 15 may be continuous and extend through the alarm unit 30, and be configured to operably communicate (e.g. electrically) with the alarm unit 30.

As previously mentioned, the cable 15 may comprise one or more conductors. At least some of the conductors may be electrically connected to the electronics disposed within the alarm unit 30, an external power source, an internal power source, and/or the article of merchandise. As such, the cable 15 functions to provide electrical power from the internal or external power source to the article of merchandise and/or data communication to or from the article of merchandise. In one embodiment, the connection of the cable 15 provides an electrical connection to the power source and/or the article of merchandise that is detectable by the alarm unit 30, such as by providing a sense loop or signal therethrough. In some instances, the cable 15 may be a standard USB cable as discussed above. In this instance, the cable 15 may include at least one conductor (e.g., power, ground, and/or data conductor). In one embodiment, the cable 15 comprises a power conductor, a pair of data conductors, and a ground conductor, while the first connector 20 and/or second connector 25 includes corresponding conductors, contacts, or pins.

Figure 3:
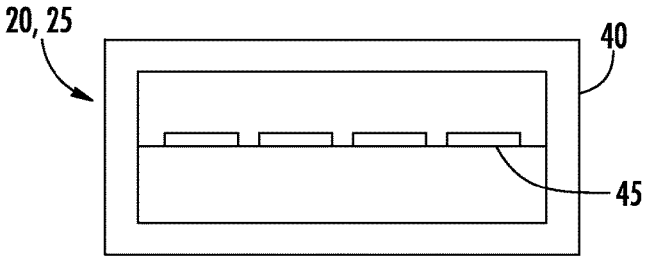
FIG. 3 is a schematic diagram illustrating a connector for use with the alarming cable of FIG. 1 and the alarming cable of FIG. 2.

In one embodiment illustrated in FIG. 3, the first connector 20 and/or the second connector 25 may further comprise a conductive sheath 40, for example an encompassing sheath formed of a conductive metal that surrounds the conductors, contacts or pins 45 disposed therein. The conductive sheath 40 is configured to electrically connect to the article of merchandise or to the power source when operably engaged therewith. The connection with the article of merchandise in turn electrically connects the circuitry of the alarm unit 30 to the article of merchandise via one or more conductors contained within the cable 15. As such, the cable 15 and second connector 25 are configured to define a sense loop or security signal between one of the conductors and the conductive sheath 40. For example, the conductive sheath 40 may be electrically connected to the ground conductor. Thus, in the event that one of the connectors 20, 25 at an end of the cable 15 is disconnected, or the cable 15 is cut, the sense loop or security signal is interrupted. The alarm unit 30 detects an interruption in the continuity of the sense loop or security signal and generates an audible and/or visual alarm signal in response thereto.

It will be readily apparent, understood and appreciated by those of skill in the art that embodiments of the present invention provide an alarming cable 10 that is cost efficient and capable of functioning as a standalone merchandise display security device. An alarming cable 10 according to embodiments of the invention is compatible with a variety of articles of merchandise and is configured to provide security from theft without affecting the existing functionality or features of the alarming cable. For example, where the alarm unit 30 is integrated with a USB cable, the USB cable maintains its existing power and/or data communication functionality. Furthermore, due to its relatively small size and position in-line with the cable 15, the alarm unit 30 is readily adaptable for various articles of merchandise and displays in a retail environment.

Figure 4:
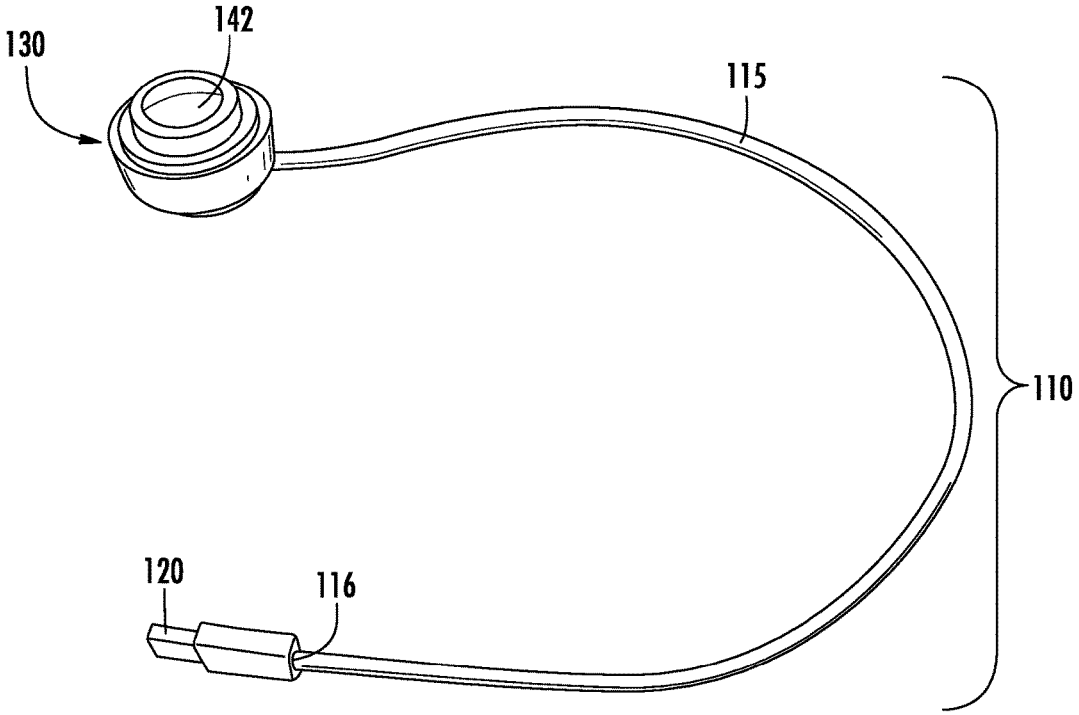
FIG. 4 is a perspective view showing an alarm unit for use with an exemplary embodiment of an alarming cable system according to the present invention.
Figure 5:
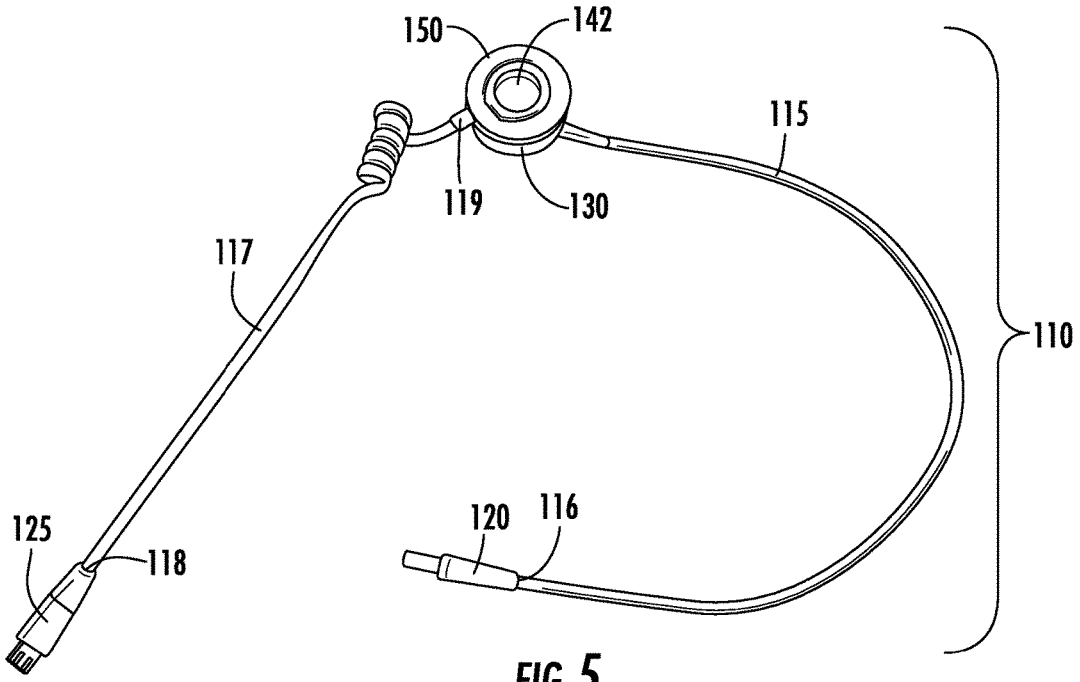
FIG. 5 is a perspective view showing the exemplary embodiment of the alarming cable system including the alarm unit of FIG. 4.
Figure 6:
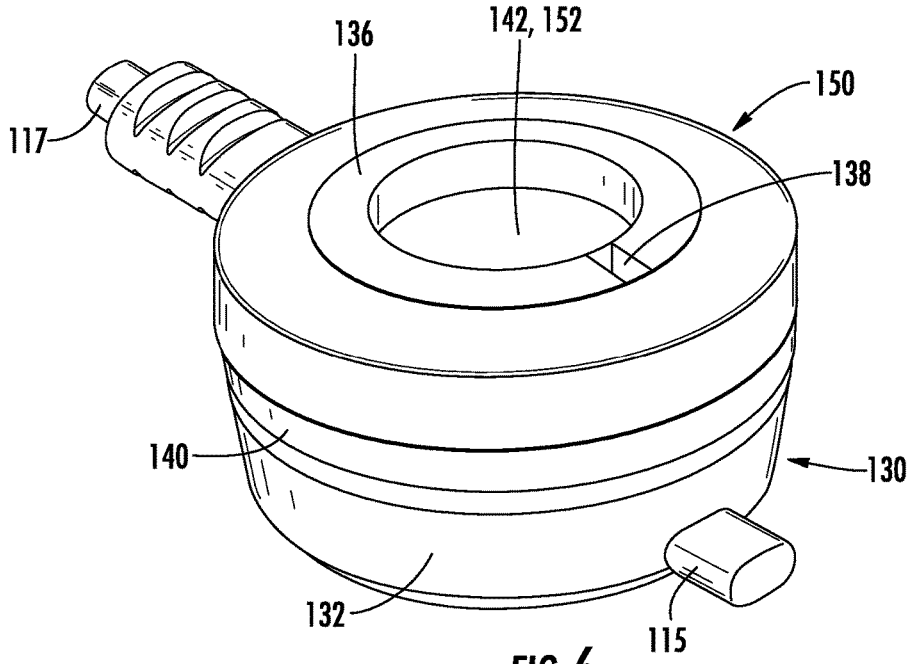
FIG. 6 is a perspective view showing an alarm unit and an alarm unit connector for use with the alarming cable system of FIG. 5.
Figure 10:
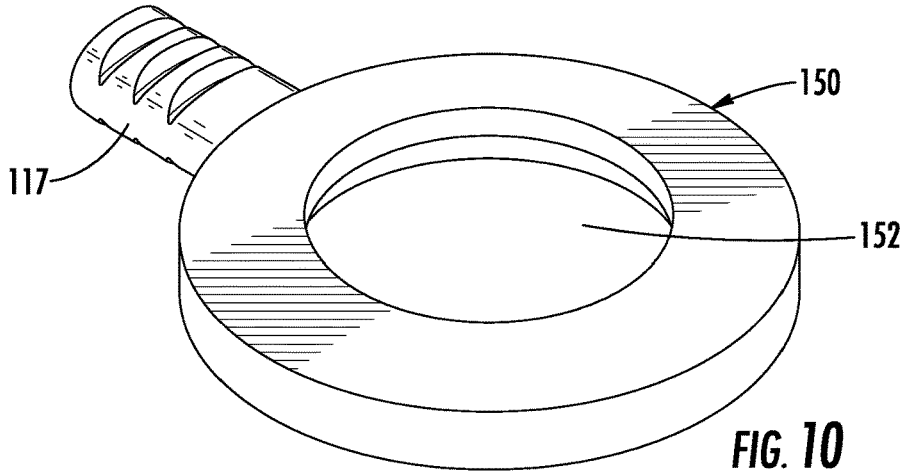
FIG. 10 is a perspective view showing the alarm unit connector of FIG. 6 in greater detail.
Figure 11:
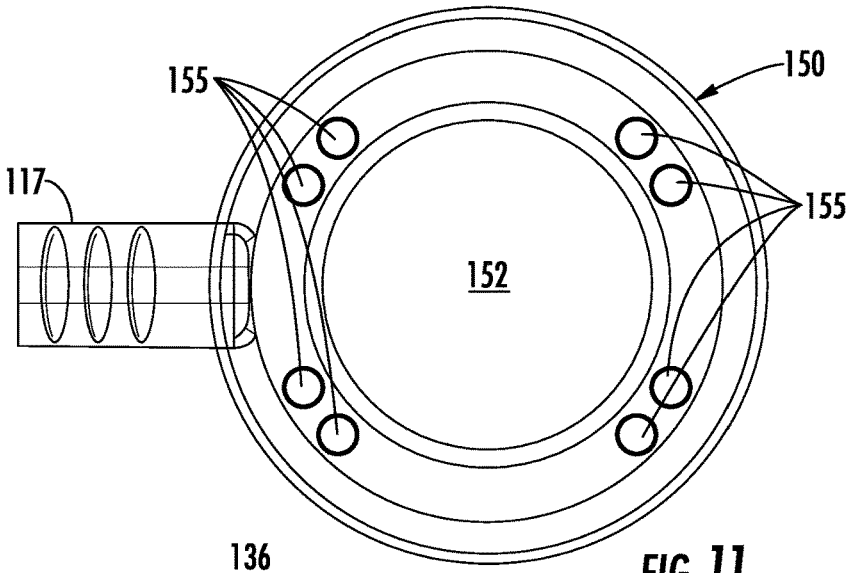
FIG. 11 is a bottom view of the alarm unit connector of FIG. 10.
Figure 12:
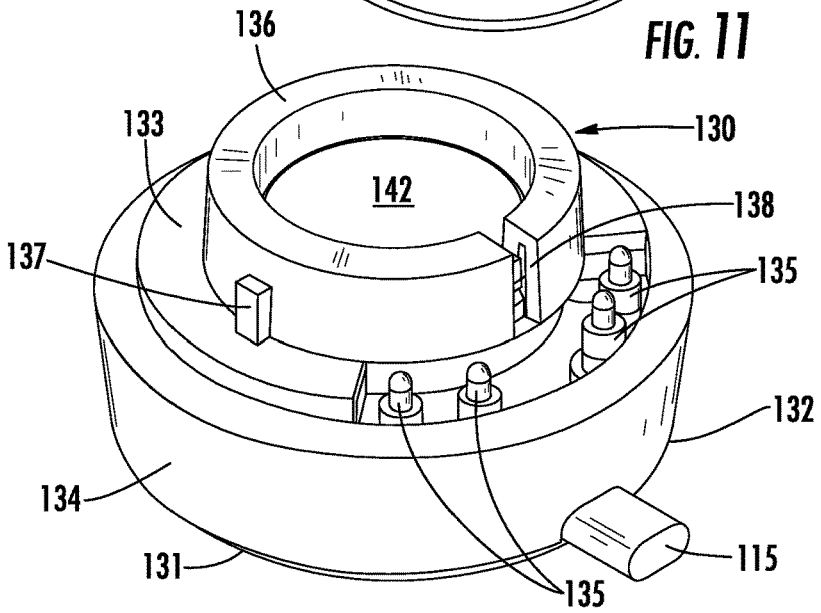
FIG. 12 is a perspective view showing the alarm unit of FIG. 6 in greater detail.
Figure 13:
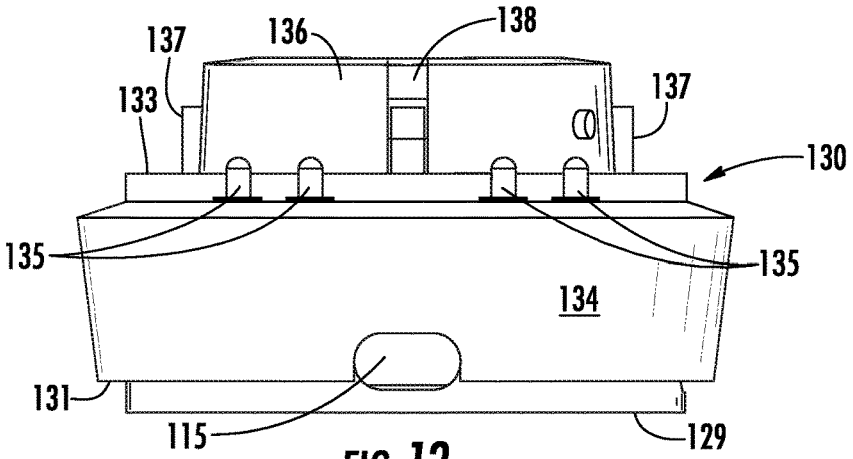
FIG. 13 is a side view of the alarm unit of FIG. 12.
Figure 14:
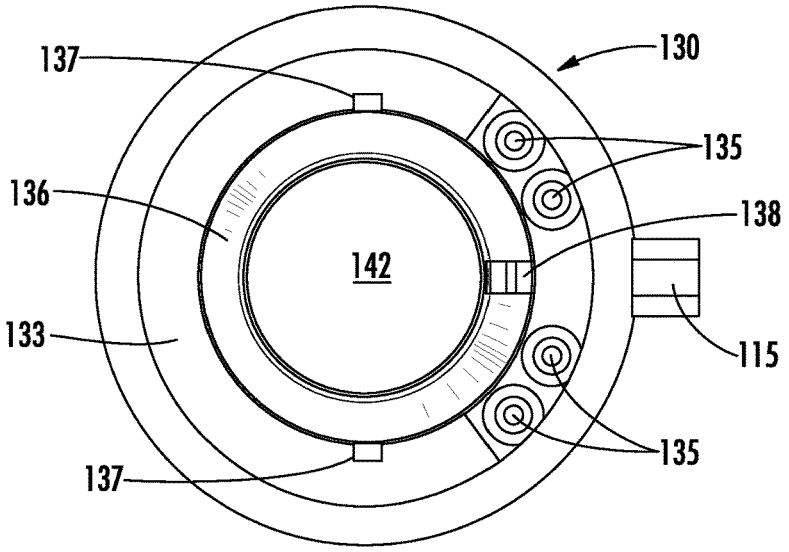
FIG. 14 is a top view of the alarm unit of FIG. 12.
Figure 15:
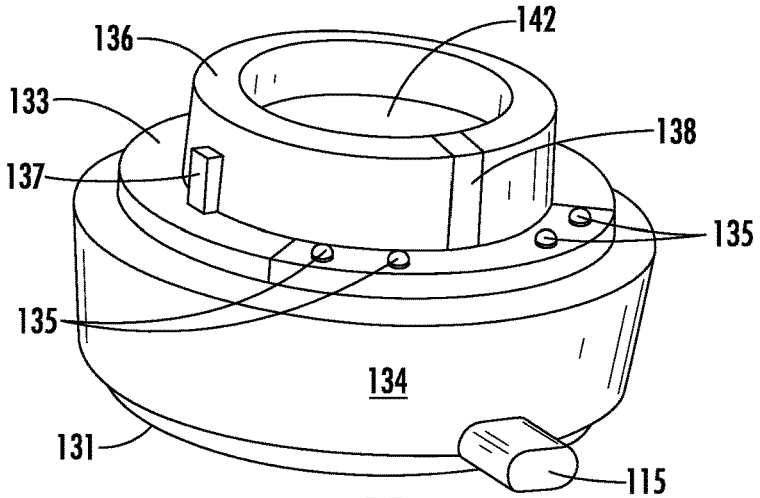
FIG. 15 is a perspective view of the alarm unit of FIG. 12.
Figure 16:
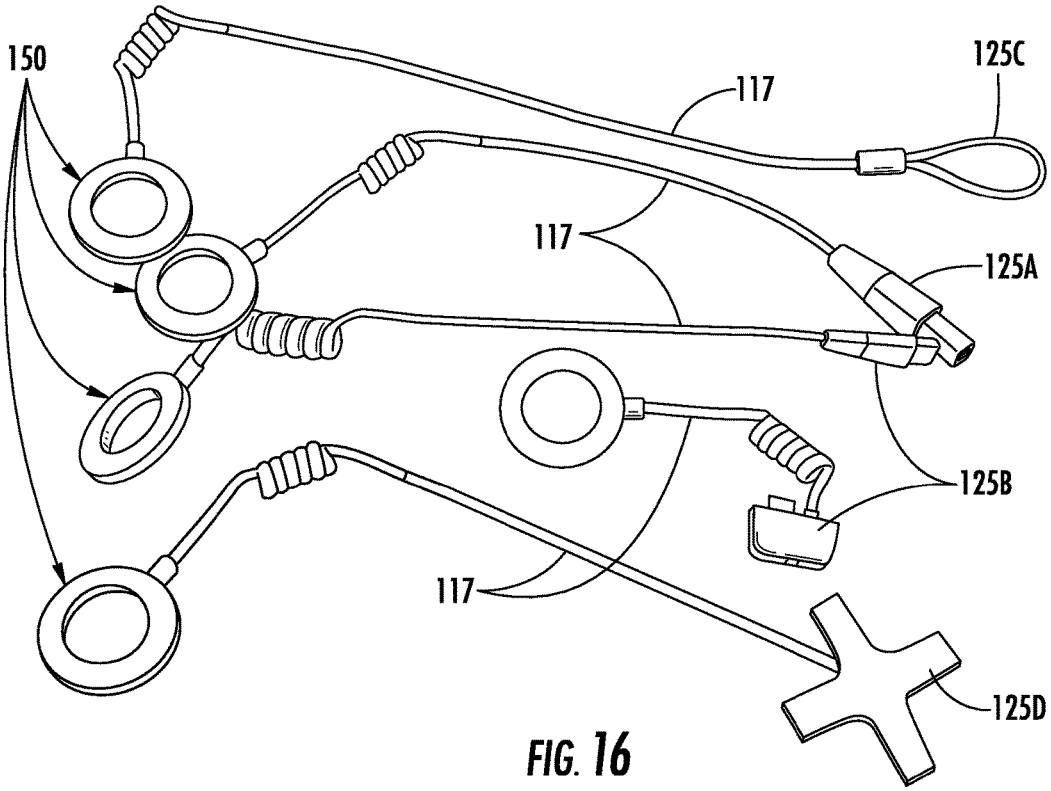
FIG. 16 illustrates a variety of different alarm unit connectors for use with the alarming cable system of FIG. 5.

FIGS. 4 and 5 show an exemplary embodiment of an alarming cable system 110 according to the invention for displaying and protecting a powered article of merchandise from theft. FIGS. 6-9 illustrate one embodiment of an alarm unit 130 and an alarm unit connector 150 for use with the system 110. FIGS. 10 and 11 show the alarm unit connector 150 in greater detail, while FIGS. 12-15 show the alarm unit 130 in greater detail. FIG. 16 shows additional embodiments of different alarm unit connectors 150 for use with the system 110. The system 110 may comprise a first cable 115 having a first connector 120 at an end 116 of the first cable for coupling to a power source. For instance, the first connector 120 could be a USB connector or any other type of connector configured to connect to a power source. The first cable 115 may contain one or more conductors for transmitting power and/or security signals between the alarm unit 130 and the power source.

The system 110 may further comprise a second cable 117 and a second connector 125 at an end 118 of the second cable for releasably engaging an article of merchandise. As previously discussed, the second connector 125 may be any suitable connector for engaging an article of merchandise. FIG. 16 illustrates various example connectors that could be employed with the second cable 117 for coupling to an article of merchandise, such as a USB connector 125A, a micro-USB connector 125B, a lasso 125C and a flexible sensor 125D. Regardless, the second connector 125 may include a light emitting element for generating a visual signal in the event that the alarm unit is armed, or is alarming. Moreover, the second cable 117 may have various lengths for accommodating a variety of articles of merchandise in different retail environments. The second cable 117 may likewise contain one or more conductors for transmitting power and/or security signals between the article of merchandise and the alarm unit 130, as previously discussed.

The second cable 117 may further include a third connector 150 at an end 119 of the second cable 117 that is configured to releasably engage the alarm unit 130, as will be described in greater detail hereinafter. Accordingly, the third connector 150 is also referred to herein as the "alarm unit connector." The alarm unit connector 150 may be annular, or ring-shaped, so as to define a central opening 152 therethrough. As shown in FIG. 11, the third connector 150 may define one or more conductive elements 155 thereon that are in electrical communication with one or more corresponding conductive wires extending through the second cable 117. For example, the conductive elements 155 may be formed by electrically conductive metallic elements. In one embodiment, the third connector 150 includes a plurality of conductive elements 155 arranged in pairs that are disposed radially opposite from one another. The remainder of the third connector 150 may be formed of any suitable non-conductive material, such as a polymeric plastic material.

As mentioned, the system 110 also comprises an alarm unit 130 operably engaged with the first cable 115, wherein the alarm unit is configured to generate a security signal in the event that the first connector 120 is removed or otherwise disengaged from the power source, in the event that the second connector 125 is removed or otherwise disengaged from the article of merchandise, and/or in the event that either cable 115 or cable 117 is cut or disconnected. The alarm unit 130 may include a base 132 and a protrusion 136 depending, or extending upwardly as shown herein, from the base. The base 132 may include a lower surface 131, an upper surface 133, and a lateral surface 134 extending therebetween. For example, the alarm unit 130 illustrated in the exemplary embodiments shown and described herein is generally circular in cross section. However, other suitable shapes and configurations may be utilized. The lower surface 131 may be configured to be secured to a merchandise display support surface or a fixture, for example via a pressure-sensitive adhesive 129 (see e.g., FIG. 7, FIG. 8 and FIG. 13), fasteners, or the like. The alarm unit 130 could also be configured to be disposed on or within a display stand for supporting the article of merchandise.

The alarm unit 130 may be formed of various materials, such as a metal material. The protrusion 136 may be annular, or ring-shaped, and depend, or extend upwardly, from the upper surface 133 of the base 132. Furthermore, the protrusion 136 may be configured to releasably engage the alarm unit connector 150. By way of example, where the alarm unit connector 150 is ring-shaped, the opening 152 may be configured to encircle a corresponding ring-shaped protrusion 136. The protrusion 136 may have a smaller outer diameter than the upper surface 133 of the base 132. The alarm unit connector 150 may couple to the alarm unit 130 in a press fit, snap fit, friction fit, or the like. In addition, a magnetic or other alignment mechanism could be used to engage and align the alarm unit connector 150 with the alarm unit 130. Moreover, the first cable 115 may be engaged with the lateral surface 134 of the alarm unit 130, which as previously mentioned may be a radial surface, although the first cable could be engaged with any desirable position on the alarm unit.

Moreover, the alarm unit 130 may include at least one conductive element 135 disposed on the upper surface 133 that is configured to operably engage the third connector (i.e. the alarm unit connector) 150 of the second cable 117. In particular, each conductive element 135 of the alarm unit 130 is configured to align with and engage a corresponding conductive element 155 of the third connector 150 of the second cable 117 so as to be in contact and electrical communication with one another. The upper surface 133 of the alarm unit 130 may include one or more engagement features 137 that are configured to align with and engage one or more corresponding engagement features (not shown) of the third connector 150 to ensure that the conductive elements 135, 155 align with and engage one another. As shown in FIGS. 12-15, the alarm unit 130 may include a plurality of conductive elements 135. The conductive elements 135 may be movable relative to the upper surface 133 of the alarm unit 130. In this regard, the conductive elements 135 may be retractable and extendable relative to the upper surface 133.

In one example, the conductive elements 135 may be biased towards an extended position. For instance, the conductive elements 135 may be similar to "pogo" pins configured to be biased outwardly from the upper surface 133. When the third connector 150 is aligned and engaged with the alarm unit 130, the conductive elements 155 of the alarm unit connector 150 engage the conductive elements 135 of the alarm unit 130 such that the conductive elements of the alarm unit are retracted downwardly to facilitate an electrically conductive connection therebetween. Where the third connector 150 includes pairs of conductive elements 155 that are located radially opposite one another, the third connector may be attached to the alarm unit 130 in different radial positions (e.g., positions 180° opposite from one another). It is understood that a variety of configurations of conductive elements 135, 155 may be employed. For example, the third connector 150 may include extendable/retractable conductive elements 155, and/or the alarm unit 130 may include a plurality of conductive elements 135 that are arranged in pairs positioned radially opposite one another.

Figure 7:
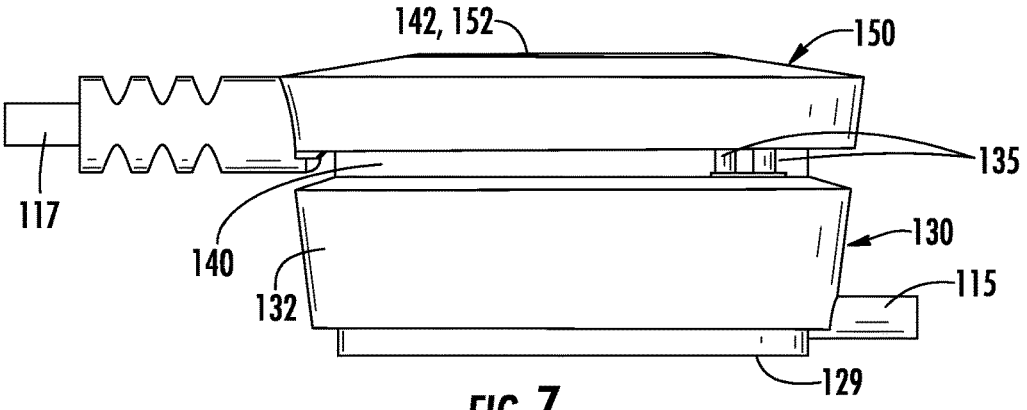
FIG. 7 is a side view of the alarm unit and the alarm unit connector of FIG. 6.
Figure 8:
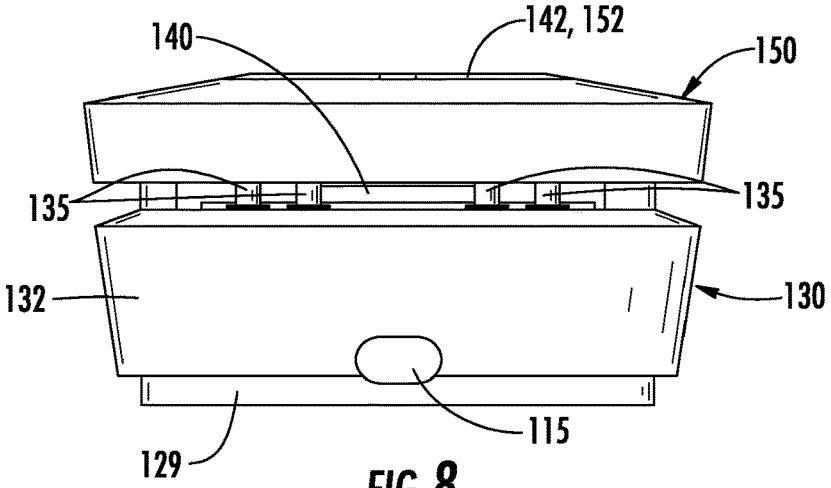
FIG. 8 is an end view of the alarm unit and the alarm unit connector of FIG. 6.
Figure 9:
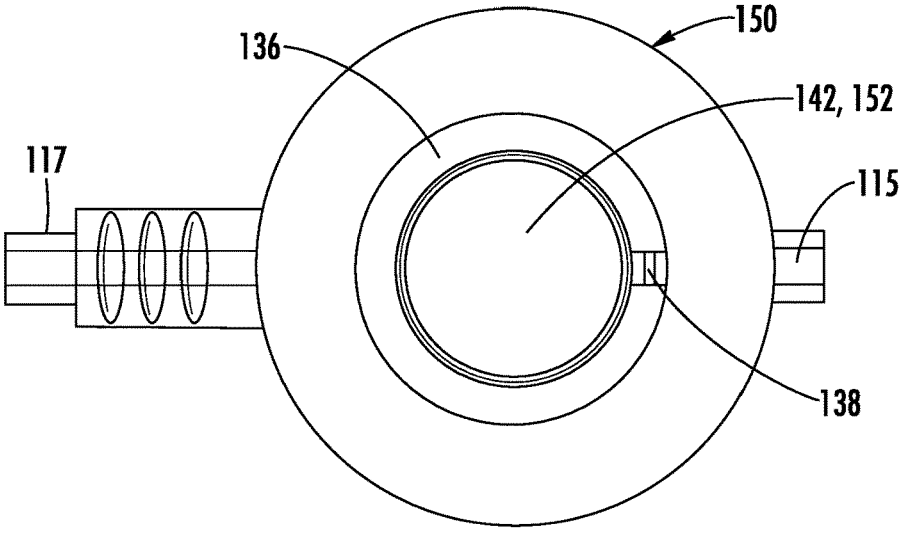
FIG. 9 is a top view of the alarm unit and the alarm unit connector of FIG. 6.

The alarm unit 130 may further include a light emitting element 138. For example, the light emitting element 138 may be utilized to indicate an armed state and/or an alarming state. In one example, the light emitting element 138 is an LED or light pipe for emitting a visual signal. At least a portion of the upper surface 133 of the alarm unit 130 may be translucent or transparent for enhancing a visual signal. For example, the conductive elements 135 and an LED 138 may be disposed adjacent to a translucent surface (see, e.g., FIG. 12). The alarm unit 130 may further include an alarm for generating a security signal, as well as alarm circuitry for monitoring security signals through the first cable 115 and/or the second cable 117, as previously discussed. Thus, should the third connector 150 be removed from the alarm unit 130, the first connector 120 removed from the power source, the second connector 125 removed from the article of merchandise, and/or either the first cable 115 or the second cable 117 cut, the alarm unit may be configured to generate a security signal. As best shown in FIG. 7 and FIG. 8, a gap 140 may be defined between the third connector 150 and the upper surface 133 of the alarm unit 130 for amplifying a security signal generated by the alarm. Thus, the gap 140 may be configured to transmit and amplify an audible and/or visual signal through the gap. In addition, the gap 140 may be defined to extend about the entire periphery (i.e. circumference) of the alarm unit 130 such that a security signal may be transmitted in all directions outwardly from the alarm unit. It is understood that the gap 140 may be defined at other locations on the alarm unit 130, such as medially between the lower surface 131 and the upper surface 133 of the alarm unit (see e.g., FIGS. 17, 19 and 20).

In another embodiment, the alarm unit 130 includes an opening, window, port or the like 142 disposed on the upper surface 133 that is configured to receive a wireless security signal for arming and/or disarming the alarm unit. The port 142 may be disposed within the protrusion 136 extending from the upper surface 133. Where the third connector 150 of the second cable 117 is ring-shaped or otherwise defines an opening therethrough, the port 142 is configured to align with the opening 152. As such, a security key may be used to transmit a security signal through the opening 152 formed in the third connector 150 and into the port 142 of the alarm unit 130. The security signal may be wireless and may be any suitable wireless signal configured to arm/disarm the alarm unit 130, as previously discussed.

Figure 17:
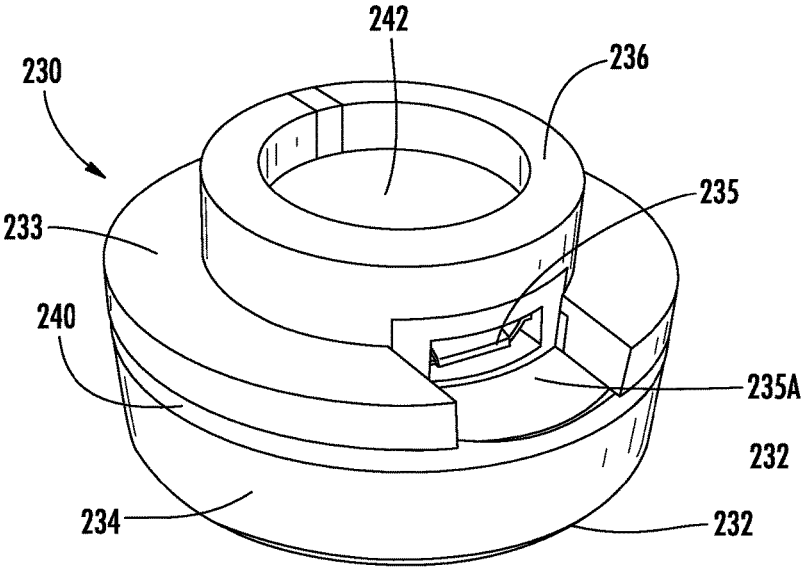
FIG. 17 is a perspective view of an alarm unit for use with another exemplary embodiment of an alarming cable system according to the present invention.
Figure 18:
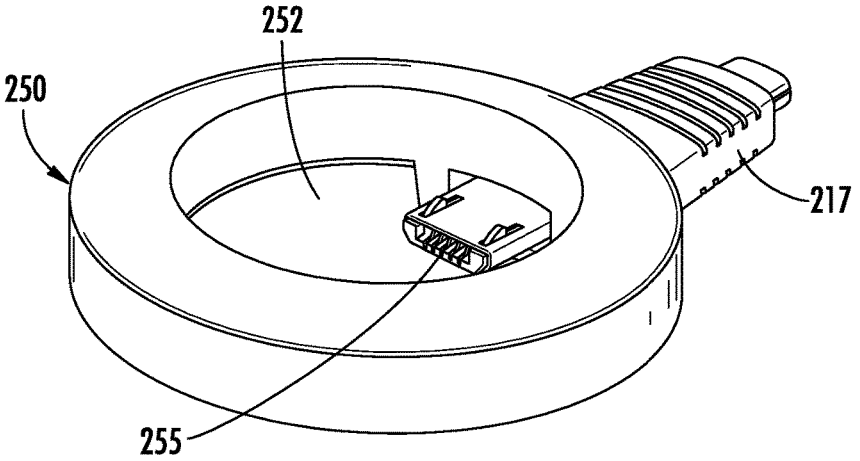
FIG. 18 is a perspective view showing an alarm unit connector for use with the alarm unit of FIG. 17.
Figure 19:
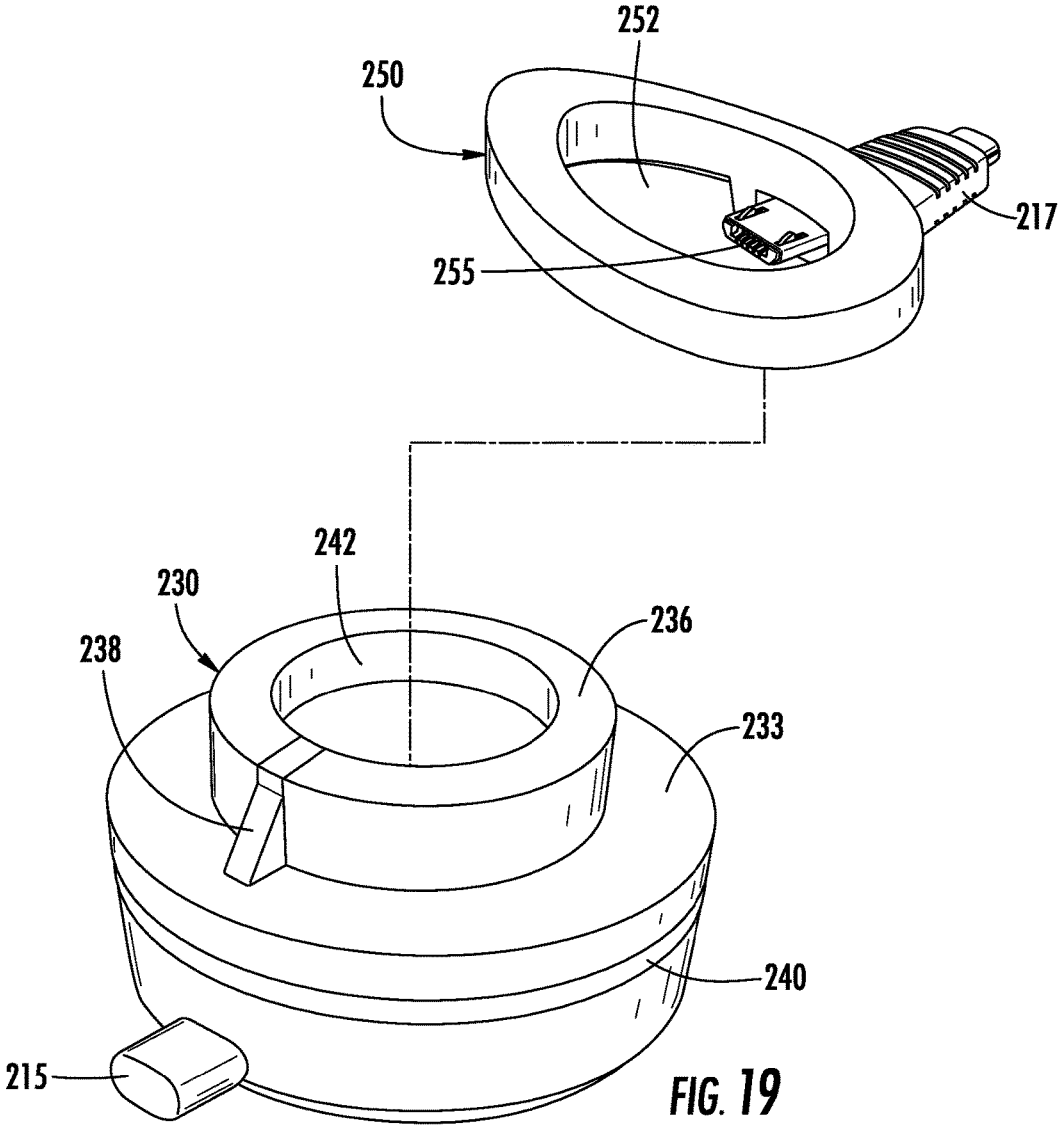
FIG. 19 is an exploded view illustrating the alarm unit connector being aligned with and engaged with the alarm unit of FIG. 17.
Figure 20:
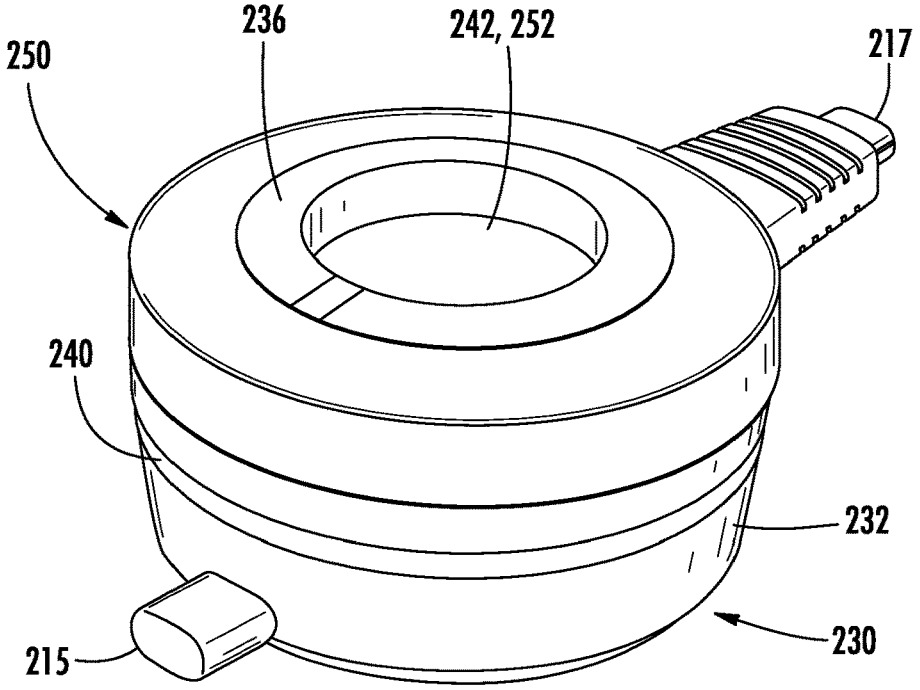
FIG. 20 is a perspective view showing the alarm unit connector of FIG. 18 aligned and engaged with the alarm unit of FIG. 17.
Figure 21:
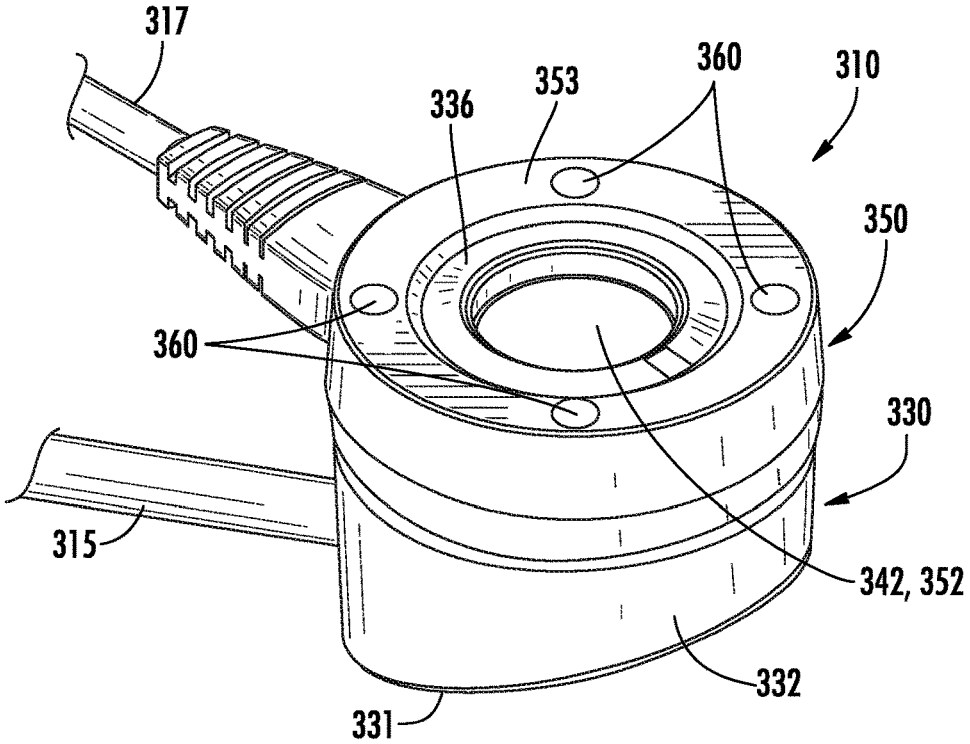
FIG. 21 is a perspective view showing an alarm unit and an alarm unit connector for use with another exemplary embodiment of an alarming cable system according to the present invention.

FIGS. 17-20 show another exemplary embodiment of an alarming cable system 210 according to the invention for displaying and protecting a powered article of merchandise from theft. FIG. 17 illustrates an alarm unit 230 including at least one connection member 235. For example, the connection member 235 may be a female micro-USB connector or any other suitable connector. The connection member 235 may be located on a radial surface 234 of the alarm unit 230. In one example, the upper surface 233 of the alarm unit 230 may define an alignment feature, such as a slot 235A, and the connection member 235 may be positioned relative to the slot for receiving a mating connection member 255 of an alarm unit connector 250. In the exemplary embodiments illustrated herein, the connection member 235 of the alarm unit 230 may be operably coupled with the protrusion 236 extending upwardly from the upper surface 233 of the alarm unit 230. As shown herein, the connection member 235 may be at least partially recessed within the protrusion 236. Furthermore, alarm unit 230 may include a first cable 215 for connection to a power source and alarm unit connector 250 may include a second cable 217 for connection to an article of merchandise in the manner previously described. As shown in FIG. 20, the first cable 215 and the second cable 217 may extend in opposite radial directions from one another.

FIG. 18 shows an alarm unit connector 250 having a central opening 252 and at least one connection member 255 disposed within the opening that is configured to align with and engage the connection member 235 of the alarm unit 230. In the exemplary embodiments illustrated herein, the connection member 255 of the alarm unit connector 250 may be a male micro-USB connector. Furthermore, the connection member 255 of the alarm unit connector 250 may be located within the central opening 252 of a ring-shaped connector. For example, the connection member 255 may extend radially inward within the opening 252. Thus, the connection member 255 of the alarm unit connector 250 may be configured to be inserted within the slot 235A and into the connection member 235 of the alarm unit 230. In one embodiment, the alarm unit connector 250 is formed of a resilient, elastic, and/or flexible material (e.g., rubber) to facilitate engagement of the connection members 235, 255.

FIG. 19 shows an embodiment of an alarm unit connector 250 that is resilient so that the connector may be manipulated (e.g., bent or flexed) to allow the connection members 235, 255 to align and engage with one another. Thus, the ring-shaped alarm unit connector 350 may be flexible to facilitate the connection between the connection members 235, 255. FIG. 20 shows the alarm unit connector 250 and the alarm unit 230 operably coupled with one another such that the connection members 235, 255 are not visible. In addition, the outer diameter of the alarm unit connector 250 and the outer diameter of the upper surface 233 of the alarm unit 230 may be substantially the same such that when assembled, the alarm unit connector and the alarm unit form a generally continuous, cohesive unit. As such, the connection members 235, 255 may not be readily apparent to a potential thief when the alarm unit connector 250 is engaged with the alarm unit 230. Furthermore, if desired, the alarm unit 230 may include a base 232 defining a lateral surface 234, an LED 238, a gap 240 for amplifying a security signal emitted by the alarm unit and/or a port 242 configured for receiving a security key in the manner previously described.

FIGS. 21-25 show an exemplary embodiment of an alarming cable system 310 according to the invention for displaying and protecting a powered article of merchandise from theft. The system 310 comprises an alarm unit 330 operably coupled to a power source by a first cable 315 and an alarm unit connector 350 operably coupled to an article of merchandise by a second cable 317. The system 310 operates essentially as previously described with respect to the embodiment shown in FIGS. 17-20. In particular, the alarm unit 330 has an alignment feature (e.g., a slot) and a connection member, and the alarm unit connector 350 has a connection member that aligns with and engages the connection member of the alarm unit in the manner previously described. However, the alarm unit 330 includes a lower surface 331 that defines an acute angle with the upper surface 333 (see FIG. 22). In this manner, the base 332 of the alarm unit 330 may be supported on a generally horizontal or vertical merchandise display support surface or a fixture such that an upper surface 353 of the alarm unit connector 350 presents a convenient viewing angle to a customer examining an article of merchandise supported on the system 310. In one embodiment, the lower surface 331 of the base 332 of the alarm unit 330 may include a relatively thin layer of a pressure-sensitive adhesive 329 for affixing the alarm unit to the merchandise display support surface or fixture.

Figure 22:
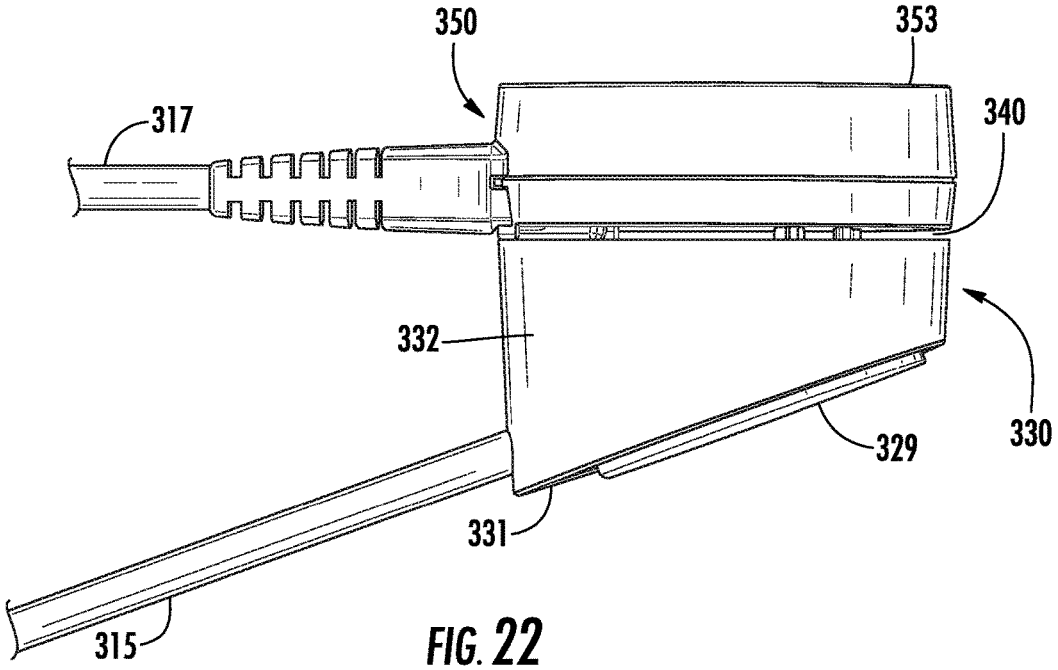
FIG. 22 is a side view of the alarm unit and the alarm unit connector of FIG. 21.
Figure 23:
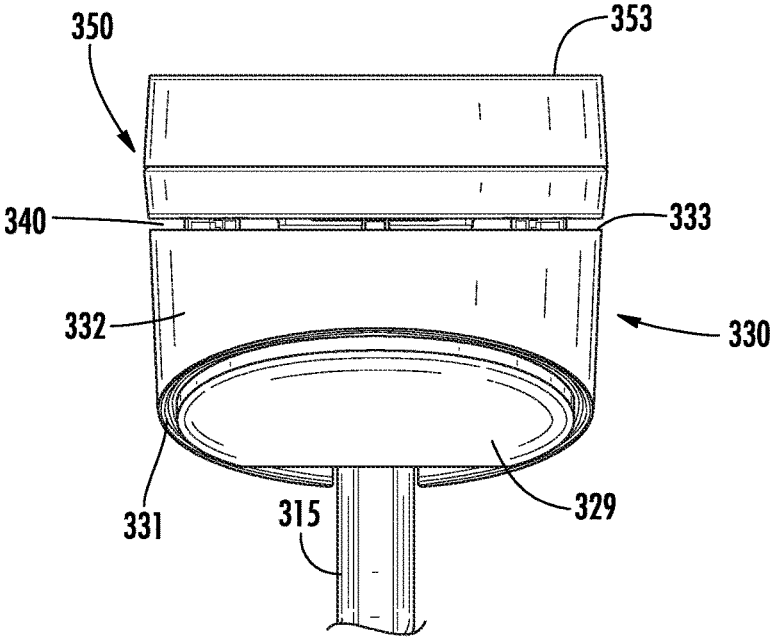
FIG. 23 is an end view of the alarm unit and the alarm unit connector of FIG. 21.
Figure 24:
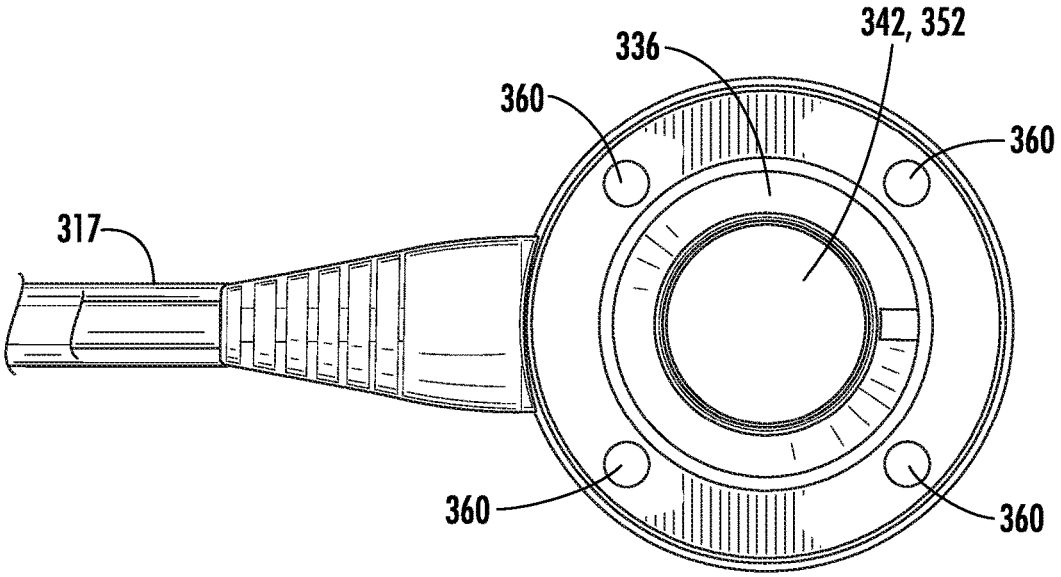
FIG. 24 is a top view of the alarm unit and the alarm unit connector of FIG. 21.
Figure 25:
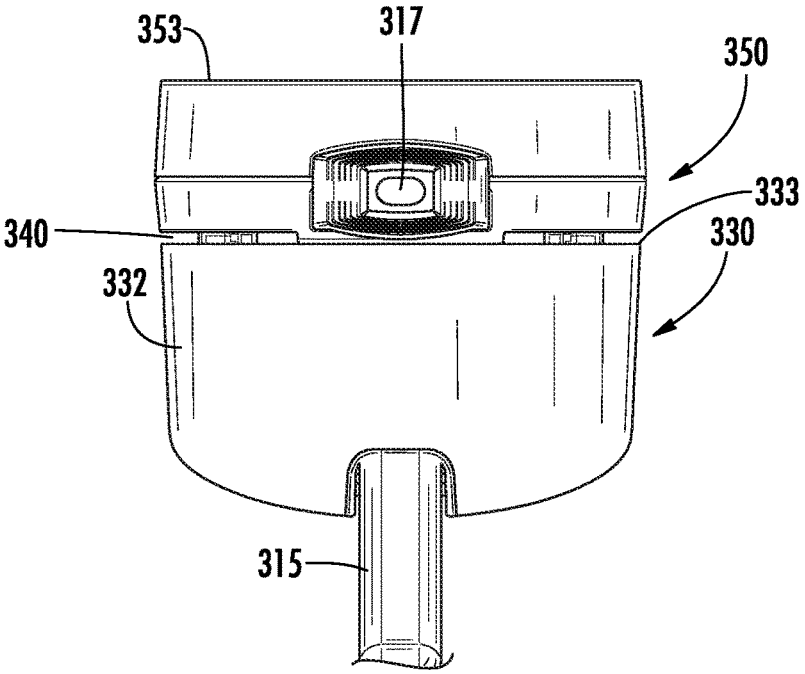
FIG. 25 is another end view of the alarm unit and the alarm unit connector of FIG. 21.
Figure 28:
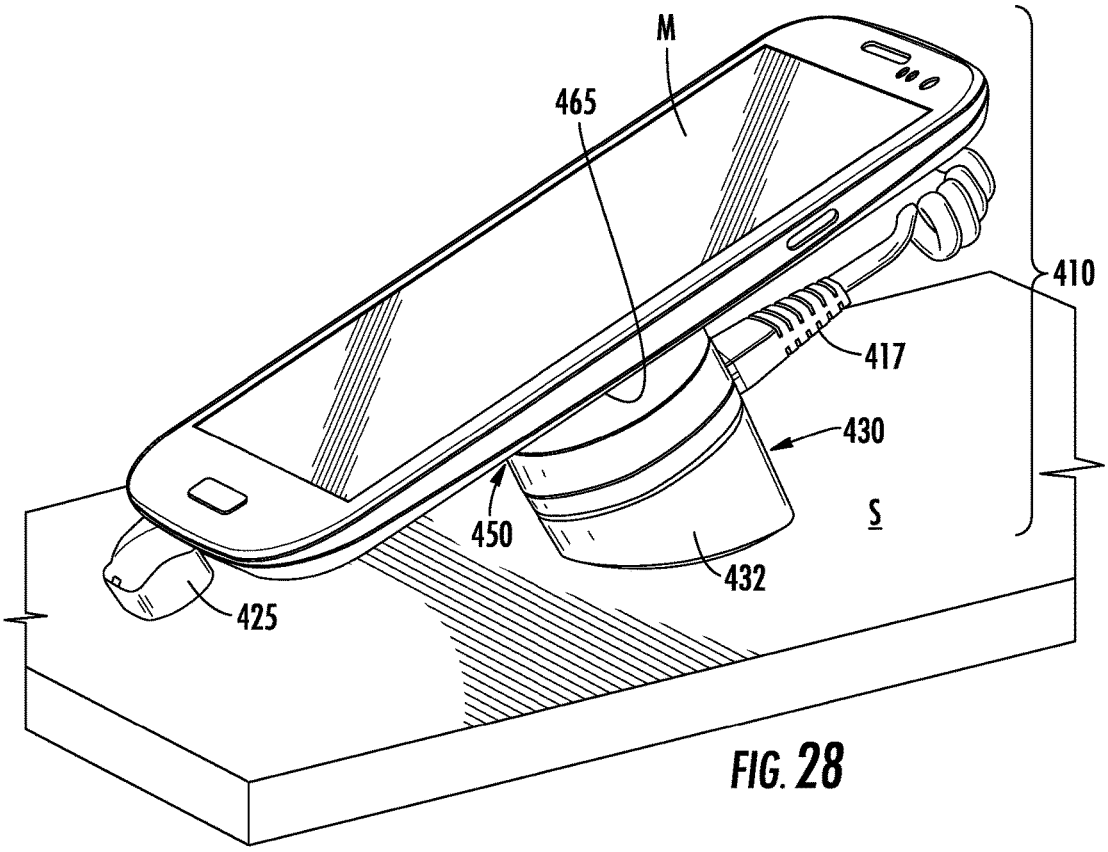
FIG. 28 is a perspective view illustrating the alarm unit connector and sensor of FIG. 26 attached to the article of merchandise and connected to an alarm unit.
Figure 29:
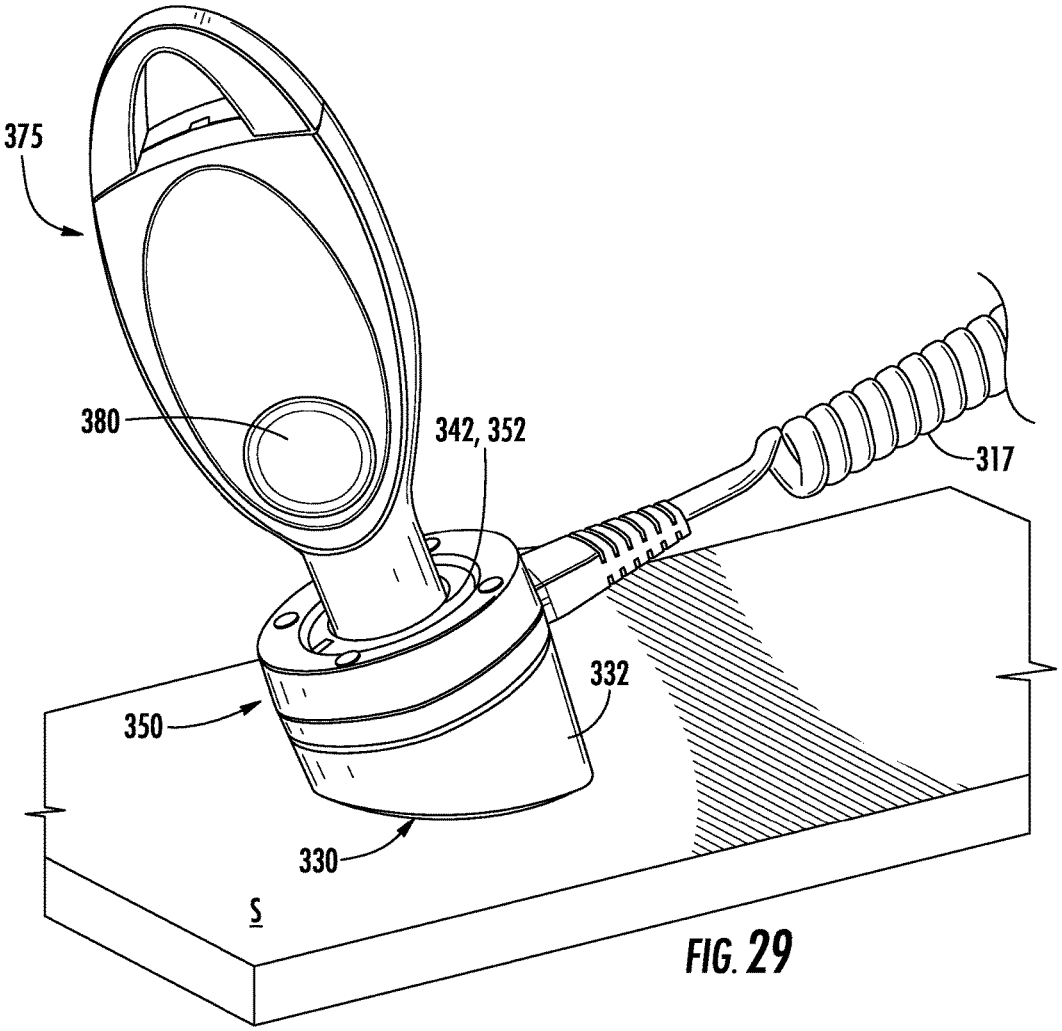
FIG. 29 is a perspective view illustrating an alarm unit connector connected to an alarm unit and a security key for arming/disarming the alarm unit according to the present invention.

As previously described, the alarm unit 330 comprises a protrusion 336 that extends outwardly (i.e., upwardly) from the base 332 of the alarm unit and defines a port 342 for communicating with a security key (see, e.g., FIG. 29). The alarm unit connector 350 defines a central opening 352 that is received over the protrusion 336 and the port 342 in a friction fit with the connection member of the alarm unit connector 350 aligned with and engaging the corresponding connection member of the alarm unit 330. In addition, the alarm unit connector 350 includes at least one, and typically a plurality, of magnetically attractive elements (e.g., magnets) 360 disposed on the upper surface 353 of the alarm unit connector for positioning an article of merchandise on the alarm unit 330 in a manner to be described hereinafter with reference to FIGS. 26-28. As discussed above, the alarm unit connector 350 may be formed of a flexible material. Thus, the magnets 360 may be secured to the flexible alarm unit connector 350 in a way that sufficiently secures the magnets and allows for flexing of the connector. As shown and described herein, pairs of the magnets 360 are arranged around the outer circumference of the upper surface 353 of the alarm unit connector 350 radially opposite one another. As shown in FIG. 22, the first cable 315 and the second cable 317 may extend in the same radial direction, which may facilitate placement of an article of merchandise on the alarm unit 330 in a desired orientation. Furthermore, if desired, the alarm unit 330 may further include a gap 340 for amplifying a security signal emitted by the alarm unit in the manner previously described.

FIG. 29 illustrates an alarm unit connector 350 connected to an alarm unit 330, as described with reference to FIGS. 21-25, and a security key 375 for arming and/or disarming the alarm unit. As previously mentioned, the alarm unit 330 comprises a base 332 configured to be secured to a support surface S or a fixture. The alarm unit connector 350 defines a central opening 352 and the alarm unit 330 defines a port 342 for receiving or communicating with the security key 375. For example, the port 342 of the alarm unit 330 may be an infrared (IR) window and the security key 375 may be configured to emit an IR wavelength pulse sufficient to energize an electrical circuit that is operable for arming and/or disarming the alarm unit. If desired, the security key 375 may be provided with an actuation button 380 that may be pressed to actuate a transmission the IR pulse from the security key into the port 342 of the alarm unit 330. The security key 375 may be configured and function in the manner shown and described in U.S. Pat. No. 7,737,845 B2 assigned to the assignee of the present invention entitled PROGRAMMABLE KEY FOR A SECURITY SYSTEM FOR PROTECTING MERCHANDISE, the disclosure of which is incorporated herein by reference.

Figure 26:
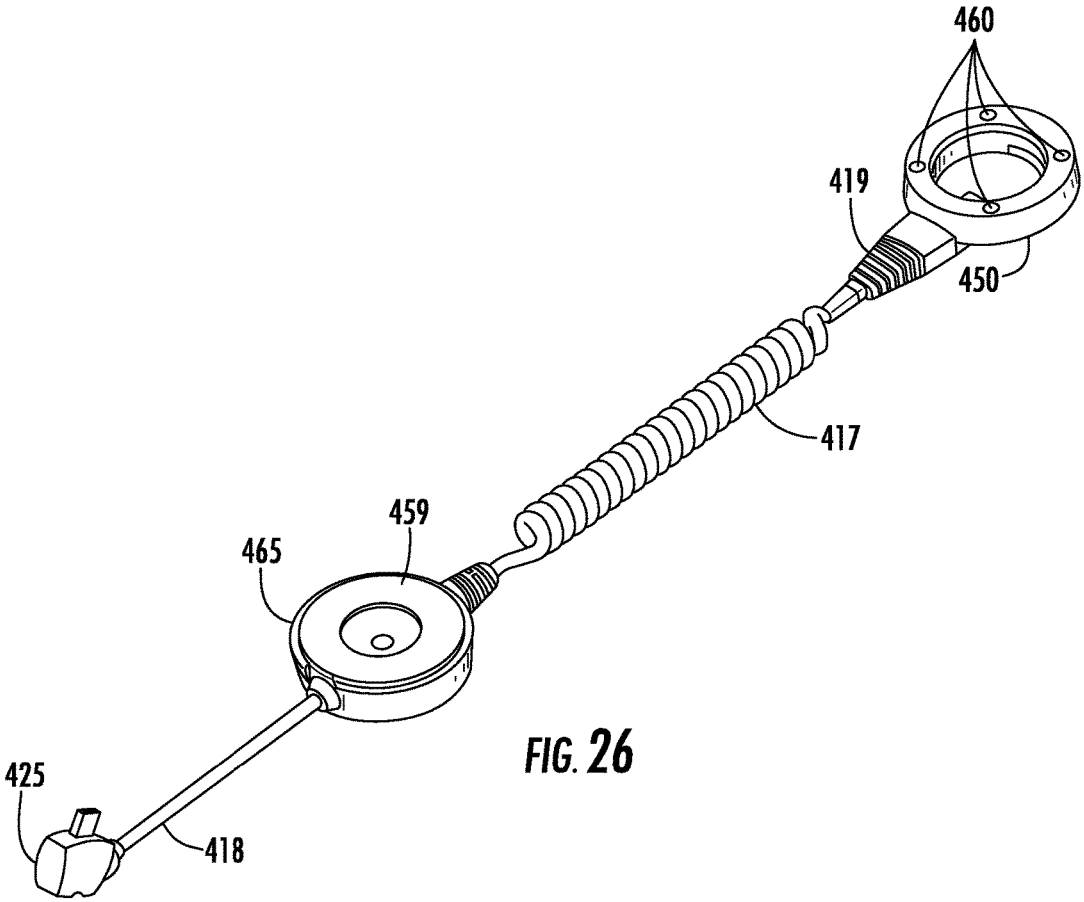
FIG. 26 is a perspective view showing an alarm unit connector having a sensor for attachment to an article of merchandise for use with another exemplary embodiment of an alarming cable system according to the present invention.
Figure 27:
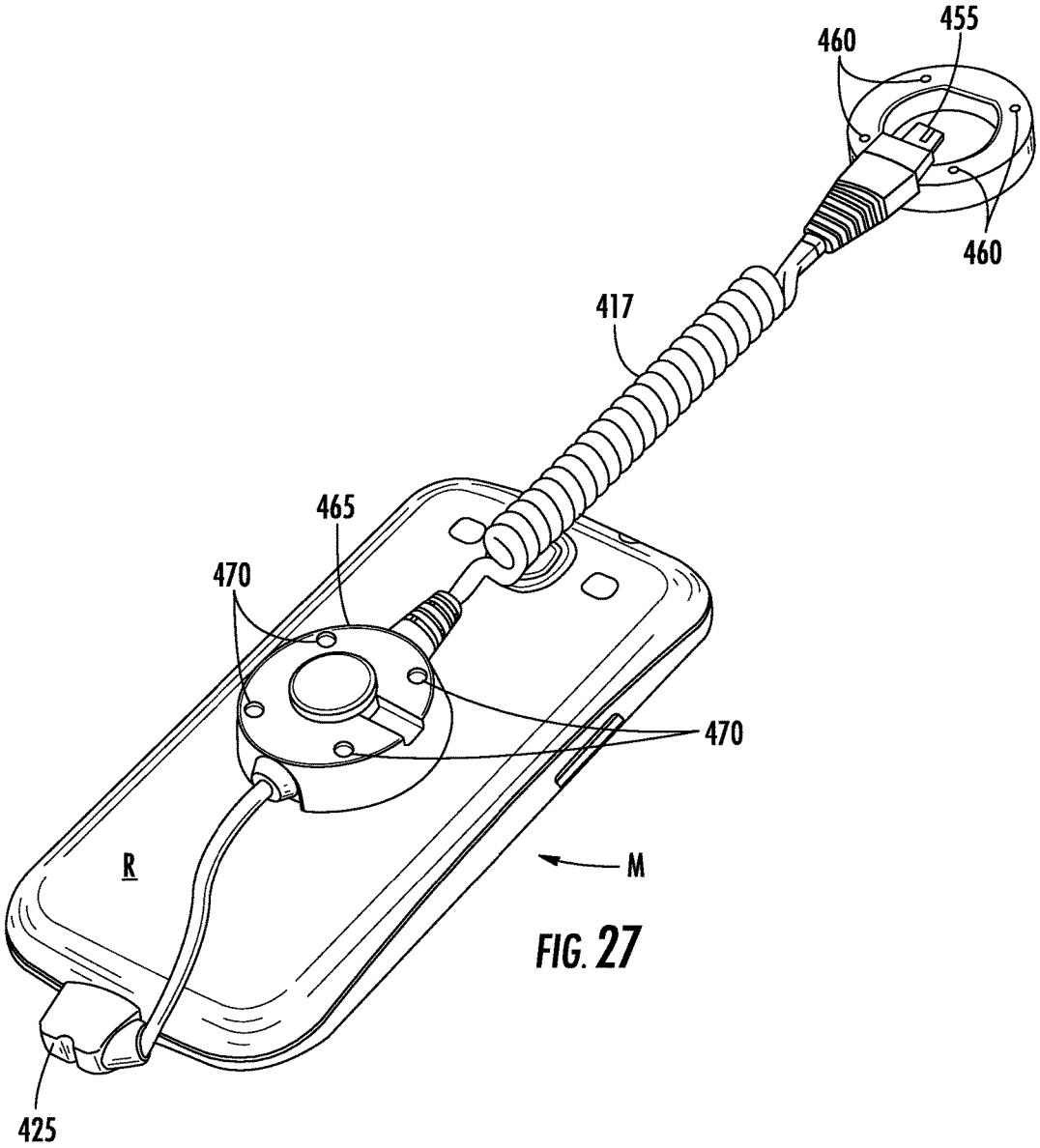
FIG. 27 is a perspective view illustrating the alarm unit connector and sensor of FIG. 26 attached to the article of merchandise.

FIGS. 26-28 show another exemplary embodiment of an alarming cable system 410 (FIG. 28). The system 410 may comprise a first cable configured for connecting an alarm unit 430 to a power source, and a second cable 417 configured for connecting the alarm unit 430 to an article of merchandise M and for providing power to the merchandise. In one embodiment, the second cable 417 has a connector 425 (e.g., a micro-USB connector) at an end 418 thereof for connection to a power input port provided on the article of merchandise M. The second cable 417 includes an alarm unit connector 450 at an end 419 of the second cable 417 having a connection member 455 (FIG. 27) that is configured to align with and engage a corresponding connection member of the alarm unit 430 in the manner previously shown and described with reference to FIGS. 17-20. The second cable 417 further includes a sensor 465 disposed between the end 418 and the end 419 of the second cable (e.g., between the connector 425 and the alarm unit connector 450). The sensor 465 is configured for attachment to the article of merchandise M as illustrated in FIG. 27. For example, the sensor 465 may be provided with a double-sided pressure-sensitive adhesive 459 that attaches the sensor to a rear surface R of the merchandise M.

As shown in FIG. 27, at least one, and typically a plurality, of magnetically attractive elements 470 (e.g., magnets) may be provided on the sensor 465 attached to the article of merchandise M. The sensor 465 may be disposed in-line between the alarm unit connector 450 at the end 419 of the second cable 417 and the connector 425 at the end 418 of the second cable 417. As shown in FIG. 28, the magnets 470 on the sensor 465 and the magnets 460 on the alarm unit connector 450 are configured to mate with one another so that the article of merchandise M may be positioned on the alarm unit 430 and the alarm unit connector 450 in a predetermined orientation with the base 432 of the alarm unit 430 secured on a support surface S. In some embodiments, the placement of the sensor 465 on the alarm unit 430 and the alarm unit connector 450 may be commercially referred to as "Perfect Placement," similar to the manner described in U.S. Pat. No. 7,740,214 B2 assigned to the assignee of the present invention entitled DISPLAY HAVING SELF-ORIENTING MOUNTING AREA, the disclosure of which is incorporated herein by reference.

The foregoing has described one or more embodiments of alarming cables, assemblies and systems for displaying and protecting a powered article of merchandise from theft. Embodiments of alarming cables, assemblies and systems have been shown and described herein for purposes of illustration. Those of ordinary skill in the art, however, will readily understand and appreciate that numerous variations and modifications of the exemplary embodiments shown and described herein may be made without departing from the spirit and scope of the invention. Accordingly, all such variations and modifications are intended to be encompassed by the appended claims.

That which is claimed is:

1. An alarming cable system for protecting an article of merchandise from theft comprising:

a first cable having a first end and a second end;

a first connector at the first end of the first cable for connecting to an external power source;

a second cable having a first end and a second end;

a second connector at the first end of the second cable for releasably connecting to an input port of the article of merchandise;

an alarm unit operably coupled with the first cable and the second cable, wherein the alarm unit is configured to generate a security signal in the event that the first cable is cut and/or the first connector is disconnected from the external power source.

2. The alarming cable system of claim 1, wherein the alarm unit further comprises a light emitting element.

3. The alarming cable system of claim 1, wherein the alarm unit comprises a port disposed on an upper surface of the alarm unit configured to receive a wireless security signal for arming and/or disarming the alarm unit.

4. The alarming cable system of claim 1, wherein the alarm unit further comprises an alarm for generating a security signal.

5. The alarming cable system of claim 1, wherein a lower surface of the alarm unit defines an angle relative to an upper surface of the alarm unit such that the article of merchandise is positioned at a predetermined orientation.

6. The alarming cable system of claim 1, wherein the second end of the second cable comprises a third connector opposite the second connector that is configured to releasably connect to the alarm unit.

7. The alarming cable system of claim 6, wherein the third connector is ring-shaped.

8. The alarming cable system of claim 7, wherein the alarm unit comprises a ring-shaped protrusion that is configured to releasably engage the third connector.

9. The alarming cable system of claim 8, wherein the alarm unit further comprises a port disposed within the ring-shaped protrusion that is configured to receive a wireless security signal for arming and/or disarming the alarm unit.

10. The alarming cable system of claim 6, wherein the third connector comprises a plurality of conductive elements configured to align with and engage a plurality of conductive elements on an upper surface of the alarm unit.

11. The alarming cable system of claim 10, wherein the plurality of conductive elements on the alarm unit are extendable and retractable relative to the upper surface.

12. The alarming cable system of claim 6, wherein the third connector comprises at least one magnetically attractive element for positioning the article of merchandise in a predetermined orientation.

13. The alarming cable system of claim 6, wherein the third connector comprises a flexible material.

14. The alarming cable system according to claim 6, wherein the third connector is a USB-type connector.

15. The alarming cable system according to claim 1, wherein the first connector is a USB-type connector.

16. The alarming cable system according to claim 1, wherein the second connector is a USB-type connector.

17. The alarming cable system according to claim 1, wherein the alarm unit is operably coupled with the first and second cables between the first connector and the second connector such that the alarm unit is disposed in-line on the first and second cables.

18. The alarming cable system according to claim 1, wherein the second ends of the first and second cables are hardwired to the alarm unit.

19. The alarming cable system according to claim 1, wherein the first and second cables are continuous with one another.

20. The alarming cable system of claim 1, wherein the first connector is a USB-type connector and the second connector is a USB-type connector.

21. The alarming cable system of claim 1, wherein the alarm unit is configured to detect an electrical connection of the first connector to the external power source.

22. The alarming cable system of claim 1, wherein the second end of the first cable is electrically connected to the alarm unit, and wherein the second end of the second cable comprises a connector for releasably engaging the alarm unit.

23. A method for protecting an article of merchandise from theft, the method comprising:

providing an alarming cable comprising:

a cable having a first end and a second end;

a first connector at the first end of the cable;

a second connector at second end of the cable opposite the first connector; and an alarm unit operably engaged with the cable and disposed between the first connector and the second connector;

connecting the first connector to an external power source;

connecting the second connector to an input port of the article of merchandise; and arming the alarm unit so that the alarm unit is configured to generate a security signal in the event that the first connector is disconnected from the external power source.

24. The method of claim 23, wherein the first connector is a USB-type connector.

25. An alarming cable system for protecting an article of merchandise from theft comprising:

a first cable having a first end and a second end;

a first USB-type connector at the first end of the first cable for connecting to an external power source;

a second cable having a first end and a second end;

a second USB-type connector at the first end of the second cable for releasably connecting to an input port of the article of merchandise;

an alarm unit operably coupled with the first cable and the second cable, wherein the alarm unit is configured to generate a security signal in the event that the second connector of the second cable is disconnected from the article of merchandise, the first cable is cut, and/or the first USB-type connector is disconnected from the external power source.

26. The alarming cable system of claim 25, wherein the alarm unit is configured to generate a security signal in the event that the first cable is cut or the USB-type connector of the first cable is disconnected from the power source.

27. The alarming cable system of claim 25, wherein the second end of the first cable is electrically connected to the alarm unit, and wherein the second end of the second cable is releasably and electrically connected to the alarm unit.

28. The alarming cable system of claim 27, wherein the second end of the first cable is hardwired to the alarm unit, and wherein the second end of the second cable comprises a connector for releasably engaging the alarm unit.

* * * * *